United States Patent [19]

Kozikowski

[11] Patent Number: 4,543,764

[45] Date of Patent: Oct. 1, 1985

[54] STANDING POLES AND METHOD OF REPAIR THEREOF

[76] Inventor: Casimir P. Kozikowski, 100 S. Mountain Dr., New Britain, Conn. 06052

[21] Appl. No.: 474,785

[22] Filed: Mar. 14, 1983

Related U.S. Application Data

[63] Continuation-in-part of Ser. No. 194,771, Oct. 7, 1980, abandoned.

[51] Int. Cl.[4] ..... E02D 5/60; E04G 21/00

[52] U.S. Cl. ..... 52/746; 52/309.3; 52/514; 52/741; 405/216

[58] Field of Search ..... 52/742, 746, 744, 742, 52/514, 515, 516, 741, 309.3; 405/216; 156/71

[56] References Cited

U.S. PATENT DOCUMENTS

| | | | |
|---|---|---|---|
| 1,512,660 | 10/1924 | Wright | 405/216 |
| 3,321,924 | 5/1967 | Liddell | 405/216 |
| 3,370,998 | 2/1968 | Wiswell | 405/216 |
| 3,390,951 | 7/1968 | Finger | 405/216 |
| 4,023,374 | 5/1977 | Colbert | 405/216 |
| 4,306,821 | 12/1981 | Moore | 405/216 |

FOREIGN PATENT DOCUMENTS

| | | | |
|---|---|---|---|
| 1445704 | 8/1976 | United Kingdom | 52/514 |

OTHER PUBLICATIONS

"Splash Zone Compound", Bulletin 214, by Pittsburgh Plate Glass.

*Primary Examiner*—John E. Murtagh

[57] ABSTRACT

The structural characteristics of standing poles are enhanced or preserved, or changed to provide breakaway characteristics, by a technique which includes forming one or more sheets about the pole. The sheets are defined by an outer jacket, a plurality of spacer members positioned within the jacket and a solidified encapsulating material which fills the jacket.

18 Claims, 9 Drawing Figures

3
3
12
34
32
34
30
18
22
24
10
14
10
42
38
18
16
16
20
20
36
10
28
24
26
40
22

25
24
40
42
40
50
48
46
44

STANDING POLES AND METHOD OF REPAIR THEREOF

CROSS-REFERENCE TO RELATED APPLICATIONS

This application is a continuation-in-part of application Ser. No. 194,771 filed Oct. 7, 1980, now abandoned.

BACKGROUND OF THE INVENTION (1) Field of the Invention

The present invention relates to standing poles and particularly to the repair or modification of the structural characteristics of wood and metal poles. Specifically, the present invention relates to the reinforcement of standing poles which have deteriorated or otherwise weakened or damaged portions and, as a result, are structurally unsound. The invention also relates to the modification of existing poles to give them "break-away" characteristics. Accordingly, the general objects of the present invention are to provide novel and improved methods of such character and to repaired or modified poles or other structural members resulting from the practice of said method.

(2) Description of the Prior Art

It is well-known that standing poles, constructed from either wood or metal, will deteriorate with time. This is of critical importance with respect to telephone poles, electrical distribution and transmission poles and steel towers. Wooden standing poles are particularly susceptible to damage caused by weather, insects, birds, rodents and other animals and rot. Steel and other metal poles and towers are particularly susceptible to damage caused by oxidation. Standing poles which have suffered considerable deterioration are structurally unsound and present a safety hazard.

In the past the unsound standing pole was often removed and a new pole was erected in its place. However, before the deteriorated standing pole could be removed the telephone transmission or electrical transmission hardware had to be disconnected and supported in some manner. This required a great deal of time and money in many cases.

Various methods of reinforcing deteriorated standing poles are known in the prior art. One prior repair method involves the positioning of reinforcing trusses around the base of the standing pole. The reinforcing trusses are bound together, and thus affixed to the pole, by metal bands. This method presents numerous disadvantages. One of these disadvantages is that the method does not prevent further deterioration from wood rot, insect damage, rust and the like. Another disadvantage is that a pile driver must be used to drive the trusses into the ground around the standing pole. The need to employ a pile driver prevents the use of this method to reinforce standing poles that are embedded within concrete or are in close proximity to other stationary objects. Rough and remote terrain, typical to cross-country transmission lines, also make this method difficult and expensive to employ. Finally, the resulting structure has a unsightly appearance which may be unwanted in certain residential or recreational areas. The use of trusses on poles which are within close proximity to highway right-of-ways may also result in increased damage in the case of a vehicle impact.

Another prior art pole repair/reinforcing method involves sectioning the standing pole just above the deteriorated area. The bottom portion of the standing pole is removed and replaced with a concrete structure. The top section of the standing pole is then permanently attached to the concrete lower pole structure. This method also presents numerous disadvantages such as, for example, the great difficulty and cost of suspending the top portion of the standing pole while the concrete section is put in place. Another disadvantage is that incident to the enhanced rigidity of repaired pole.

Another prior art method for repairing metal standing poles and towers involves removing the rust and then welding new metal to the structure. This method is expensive and time consuming due to the need for welding and cutting machinery. Also, this method fails to prevent further deterioration, and in some circumstances promotes it.

It is to be noted that there is a trend in highway safety engineering to require poles in proximity to the right-of-way to break-away upon automobile impact. While steel poles having break-away characteristics can be used in new installations, such poles are comparatively expensive. Further, it would be exceedingly expensive to replace existing wood poles with new metal break-away poles.

SUMMARY OF THE INVENTION

The present invention overcomes the above-discussed disadvantages and other deficiencies of the prior art by providing a novel technique for the repair or modification of wood and metal standing poles. The invention also encompasses the resulting poles and apparatus for use in the practice of the novel technique.

A reinforcement method for wood and metal standing poles in accordance with the present invention involves forming a jacket around the deteriorated area of the standing pole and pouring an inert filler material between the jacket and pole to thereby define a reinforcement medium. The first step in constructing a reinforcement medium in accordance with the present invention comprises inspecting the standing pole to determine the extent of the deterioration. In the case of wood standing poles all wood rot and other areas of deterioration are scraped from the standing pole. If the deterioration is below ground level, a hole is dug around the base of the standing pole to fully expose the deteriorated area. After the pole has been cleaned of wood rot and like material, spacially displaced vertically oriented spacer members are attached to the pole. A jacket, spaced outwardly from the pole and in contact with the spacer members, is then formed from a flexible structural material which is inert and capable of withstanding weathering and other causes of standing pole deterioration.

After the jacket is secured in position an inert filler material is poured between the jacket and the standing pole. Preferably this is accomplished by inserting a funnel into the top of the jacket. In accordance with a preferred embodiment, a novel reusable funnel is formed by wrapping a partial-annulus-shaped sheet around the pole and securing it into position. This sheet may be formed from any material capable of functioning as a funnel. After the inert filler material is poured the funnel is removed.

Deterioration of metal standing poles is primarily caused by rust. This rust must be removed prior to the construction of the reinforcement medium. After the rust has been fully removed, vertically oriented spacer members are positioned around the standing pole and the remaining steps of the method of construction are the same as with wood standing poles.

In another embodiment of the present invention, for use with wood standing poles, the pole is sectioned just above the deteriorated area. The deteriorated area is then removed and replaced with a new section comprised of wood or other material. The two sections of standing pole are then joined by constructing a reinforcement medium about the joint of the two sections.

In accordance with a further embodiment the present invention may be employed to convert existing wood poles into break-away poles. This is accomplished by sectioning the pole and employing a pair of reinforcing mediums to respectively reinforce the upper and lower pole sections. The reinforced sections are rejoined through the use of novel hardware which enables the pole to withstand normal wind and ice loads but to separate upon a horizontally directed impact of magnitude commensurate with a vehicle impact.

In accordance with yet another embodiment, the facing ends of a pair of pole sections are provided with an irregular, complementary configuration. Accordingly, when in the correct abutting position, the pole will be self-supporting and the reinforcing procedure of the present invention may be practiced without the necessity of continuing to support the upper pole section, and perhaps its load of cables and hardware, while the filler material is poured and cures.

Accordingly, the present invention has, as some of its numerous objectives, the enhancement of the strength of deteriorated standing poles, protecting standing poles from further deterioration and/or changing the structural characteristics of standing poles. The present invention accomplishes the above and other objects while providing an acceptable appearance. Also, employment of the present invention enables a pole to be repaired without the necessity of temporarily disrupting or diverting service thereby enabling a utility to continuously serve its customers.

BRIEF DESCRIPTION OF THE DRAWING

The present invention may be better understood and its numerous objects and advantages will become apparant to those skilled in the art by reference to the accompanying drawing wherein like reference numerals refer to like elements in the several FIGURES in which.

DESCRIPTION OF THE PREFERRED EMBODIMENT

Figures 1, 2, 6:
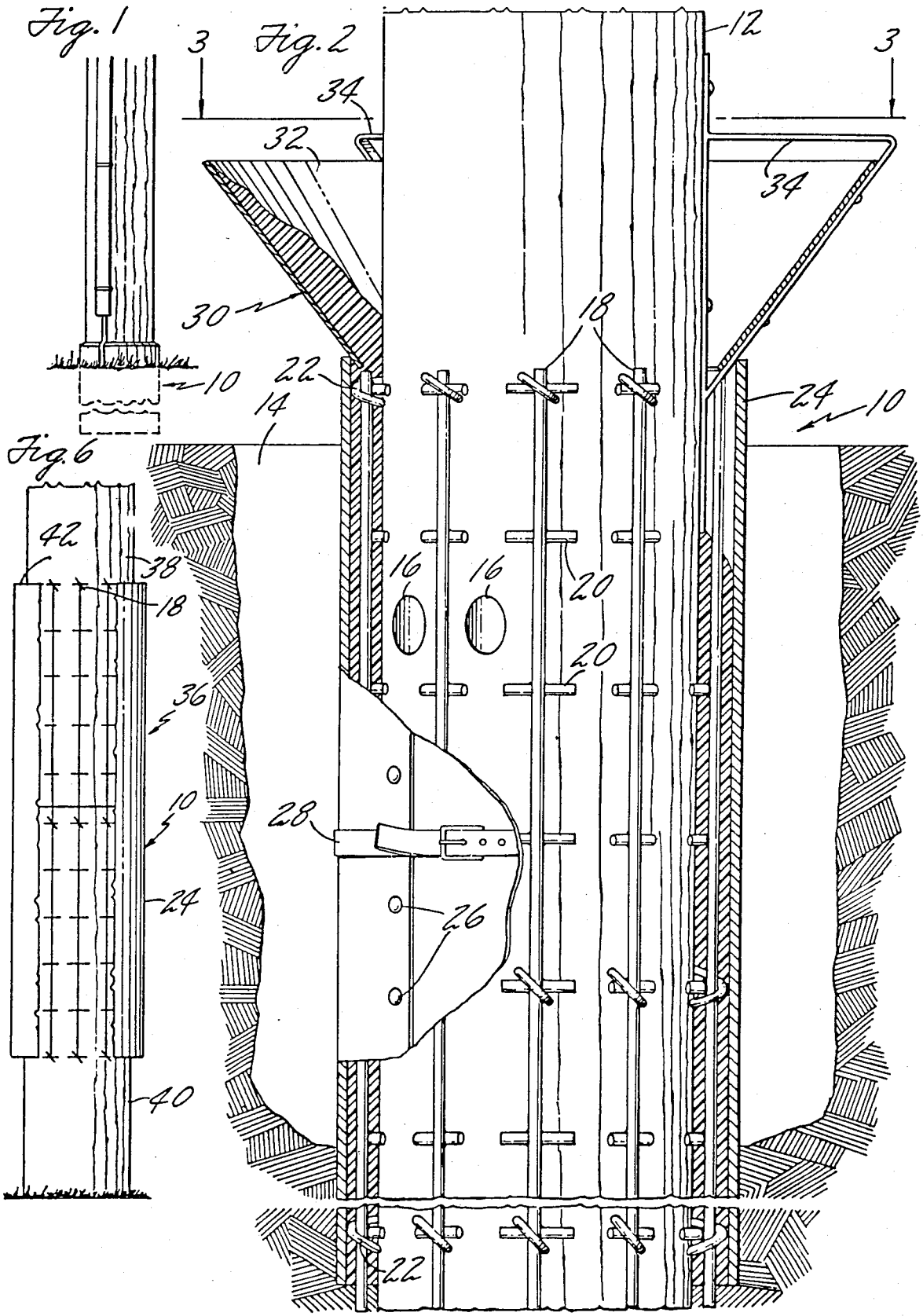
FIG. 1 is a perspective view of a standing pole repaired in accordance with the present invention.
FIG. 2 is an enlarged cut-away view which depicts the installation of the reinforcement medium of FIG. 1 around a wood standing pole in accordance with the invention.
FIG. 6 is a partially cut-away view of another embodiment of the present invention which depicts two standing pole sections joined together by a reinforcement medium in accordance with the present invention.

Referring to FIG. 1, one embodiment of a novel reinforcement medium in accordance with the present invention is indicated generally at 10. In this embodiment reinforcement medium 10 was constructed around a wood utility pole which had a deteriorated region beneath ground level. Reinforcement medium 10 imparts additional strength to the standing pole and prevents further deterioration thereby extending the life of the pole. While FIG. 1 illustrates the use of reinforcement medium 10 in conjunction with a wooden utility pole it is emphasized that the present invention may be used with any type of standing pole constructed of either wood or metal.

The method of construction of one embodiment of the present invention may be seen by reference to FIG. 2. Standing pole 12 is first examined to determine the extent of deterioration. As illustrated in FIG. 2, if the deteriorated area extends below ground level, a hole 14 is dug around the base of pole 12 to fully expose the deteriorated area. The exterior surface of pole 12 should be scraped clean of any deterioration. In wood poles this would include dirt, wood rot and the like. When working with metal standing poles this would include the scraping of rust. Furthermore, wooden standing poles may have interior damage caused by wood rot or insects. If after examination of pole 12 it is determined that interior deterioration exists, a plurality of horizontal holes 16 are drilled into the area of damage. After pole 12 has been fully cleaned and any necessary holes 16 drilled, vertical spacer rods 18 are secured to pole 12 such as, for example, by stapling. When working with wooden standing poles, rods 18 are preferably comprised of steel. When working with metal standing poles, rods 18 are preferably comprised of wood. In the preferred embodiment of the present invention, rods 18 are substantially evenly spaced around pole 12. Rods 18 may have a diameter of one-quarter inch for standing poles having a diameter of thirteen inches or less and may have a greater thickness for standing poles of larger diameter. When working with wooden standing poles the preferred configuration of rod 18 is a vertical member with a plurality of short horizontally extending stubs 20 attached thereto. The attaching staples are indicated at 22. The rods 18, stubs 20 and staples 22 space a jacket 24 from the pole to create an annular void of the proper width. The stubs 20 are located behind rods 18 to space rods 18 from the pole to thereby permit the rods to be totally encapsulated in a resinous filler material whereby the hardened filler will be reinforced.

After rods 18 have been attached to pole 12, a jacket 24 is formed from a sheet of flexible structural material. As may be seen from FIG. 7, the sheet material from which jacket 24 is formed has a tongue and groove arrangement, the grooved first edge being indicated at 25. The sheet will be wrapped around the pole and spacer rods, cinched tight using any suitable technique, scribed, removed, cut to size and reinstalled with the single layer edge (the tongue) engaged in the groove 25 defined by the other, double layer edge. The sheet of FIG. 7 may thus be utilized regardless of pole diameter. After being refitted, the sheet which defines jacket 24 is typically secured to itself by means of a plurality of self tapping screws 26 which are passed through the tongue and groove portion. Jacket 24 may be comprised of fiberglass, polyvinyl chloride, epoxies, polyesters or other materials which will resist weathering and other conditions which cause deterioration of standing poles. In the preferred embodiment of the present invention jacket 24 is formed from a sheet comprised of successive layers of any epoxy resin and fiberglass cloth. Jacket 24 should at least cover spacer rods 18 and preferably will extend beyond both ends of the rods whereby exposure of the rods to the elements will be avoided.

After jacket 24 is in position an inert filler material, not shown, is poured between jacket 24 and pole 12. Before pouring the inert filler material, at least one strap 28 may be positioned around jacket 24 to provide additional support. The inert filler material will typically be comprised of an epoxy resin. It is to be understood that this inert filler material must be compatible with and give an excellent bond to the jacket and to the standing pole with which it is used. This is especially important with wooden poles which are impregnated or covered with resin, creosote, tars and other preservatives. The inert encapsulating or filler material must be able to flow and fill the spaces between rods 18.

In accordance with one embodiment, the encapsulating material is a two-component, 100% solids, i.e., no solvents, moisture insensitive epoxy system, which will not shrink, to which a quartzite agregate filler is added. The first or "A" component of the system is a formulation of bisphenol-A resin while the "B" component is a formulation of polyamine hardeners. The quartzite agregate filler is oven-dried silica having a particle shape and size compatable with the epoxy system. In a typical case the ratio of finished resin to quartzite filler is one (1) part to three (3) parts although the ratio may vary from 1:0 to 1:4.

Figure 4:
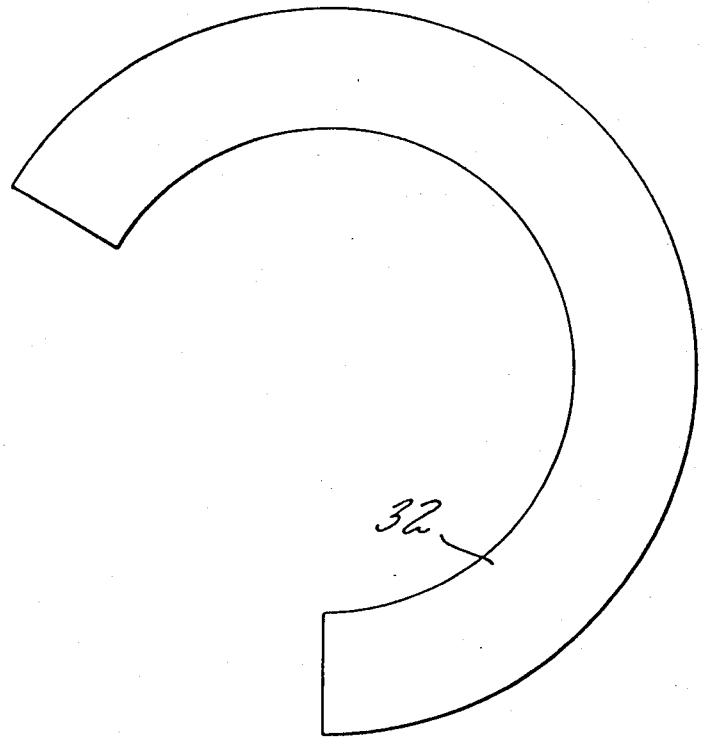
FIG. 4 is a top view of the partial-annulus-shaped sheet used to form the funnel shown in FIGS. 2 and 3.

To aid the pouring of the filler material between pole 12 and jacket 24, a funnel 30 is formed around pole 12. Funnel 30, having a shape of an inverted-frustum of a cone, is formed by wrapping sheet 32 around pole 12. Sheet 32 has a flat shape as illustrated in FIG. 4. Sheet 32 may be comprised of any flexible material such as cardboard, plastic, metal, fiberglass, or any like material. Funnel 30 has its smaller end inserted into the top of jacket 24. Sheet 32 may be formed into a funnel which will fit any size pole and typically will be comprised of a reusable material.

Figure 3:
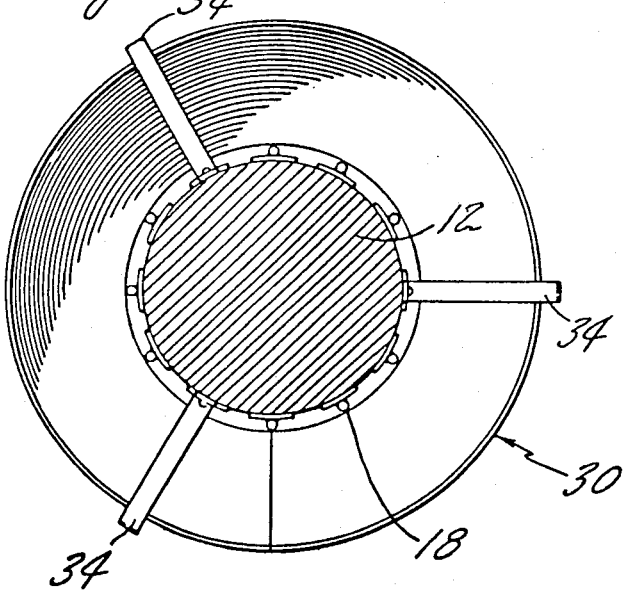
FIG. 3 is a view of FIG. 2 taken along line 3—3.
Figure 5:
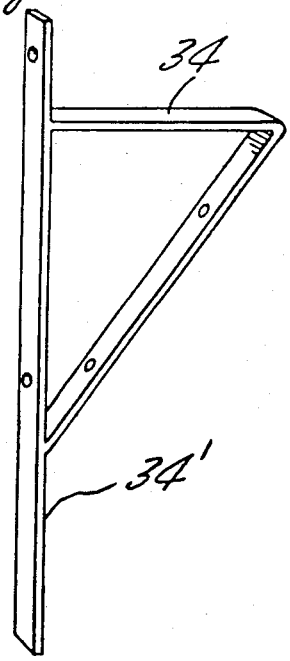
FIG. 5 is a perspective view of the funnel support brackets shown in FIGS. 2 and 3.

Funnel 30 is typically held in position by at least two brackets 34. Brackets 34 have an angularly oriented arm as illustrated in FIG. 5, and may be comprised of metal, plastic, or any material which will have the requisite structural strength. Brackets 34 have their lower end 34', inserted between pole 12 and jacket 24. In the preferred embodiment of the present invention brackets 34 are first placed in position and then sheet 32 is wrapped through the brackets such that the angularly oriented arms define the shape of funnel 30 as depicted in FIGS. 2 and 3. The smaller end of funnel 30 may be taped to the top end of jacket 24. The bottom end of jacket 24 is, in the embodiments of FIGS. 1, 2, and 6, plugged with a compressible foam strip to prevent leakage of the inert filler material.

To insure that the inert filler material completely fills the area scraped clean and holes 16, a vibrator, not shown, may be used. This vibrator is placed above funnel 30 and vibrates pole 12 during pouring of the inert filler material. While the vibrator is especially advantageous when holes 16 have been drilled through the pole, excellent results may be obtained without use of a vibrator. The resin employed as the encapsulating material in the practice of the present invention, either by its own nature and/or because of vibration, will also fill any "weather checks", i.e., vertical cracks, resulting from expansion and contraction, in the pole and thereby enchance the structural integrity of the pole.

After the inert filler material is poured, brackets 34, funnel 30 and straps 28 are removed. The outer surface of jacket 24 is then cleaned, if necessary, and any hole 14 is backfilled.

Referring now to FIG. 6, another utilization of the present invention is depicted. In FIG. 6 a wooden standing pole 36 was sectioned above a deteriorated area. The lower pole section has been removed and replaced with a new butt section 40. Old wooden pole section 38 and new pole section 40 are joined together by a reinforcement medium 10 formed in the manner described above. Repair of the pole 36 may be facilitated by forming complementary irregular surfaces, for example a step pattern, in the abutting faces of the pole sections which are to be joined. The interlocking engagement provided by the thus formed abutting faces renders the pole partially self-supporting. An adhesive may be applied to the abutting surfaces. Once the spacer members have been affixed to the pole sections, and/or the sections joined by steel strapping, the machinery which has been used to support the upper pole section and its load of cables may be removed. This frees the equipment for use on another project, i.e., the crane or other machinery does not have to remain in position until the filler has been poured and has cured.

Figures 7, 8, 9:
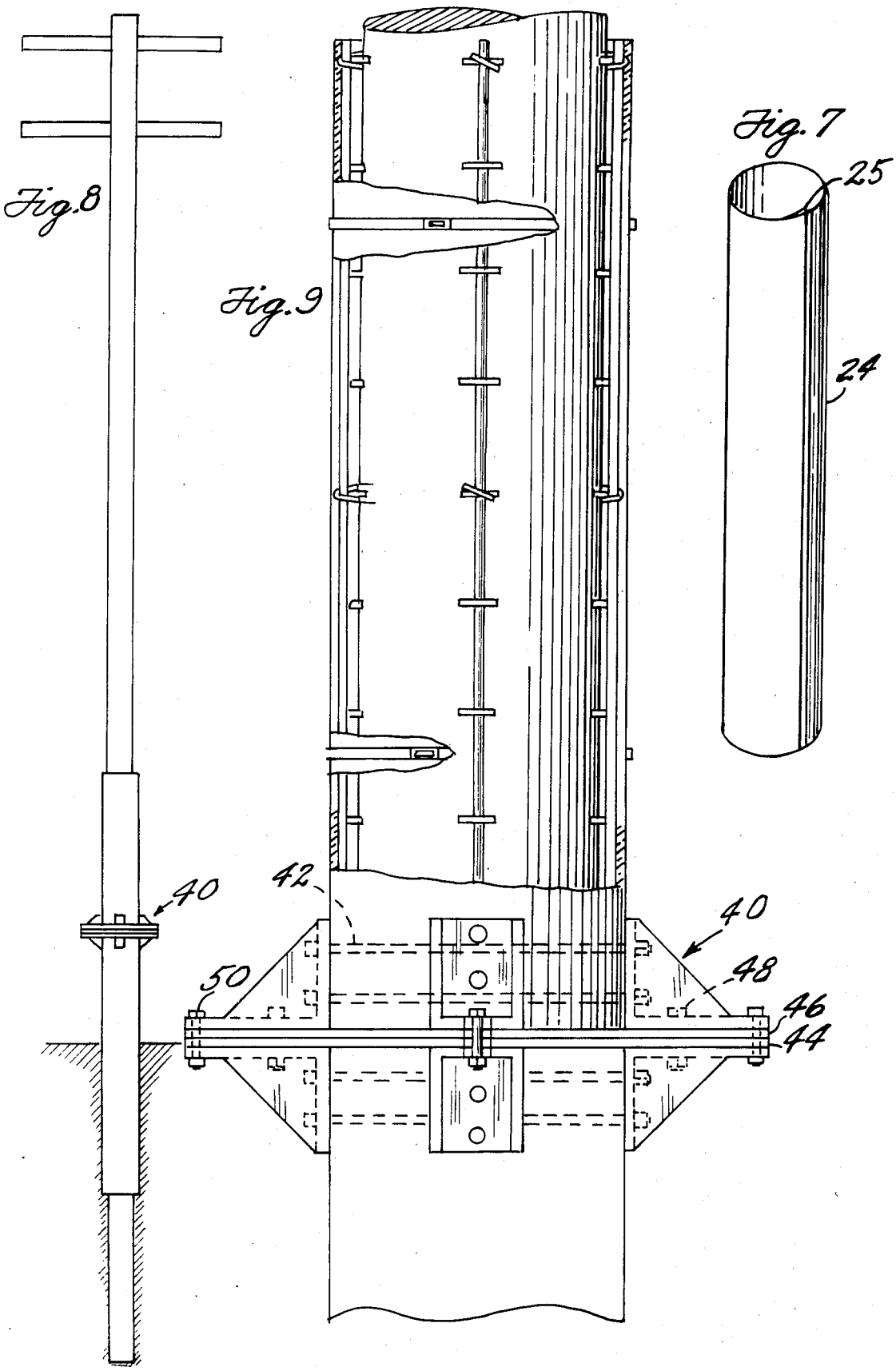
FIG. 7 is a perspective view of the sheet material used to define the sleeve which forms the exterior of the reinforcement medium of the present invention.
FIG. 8 is a side-elevation view of a break-away pole produced in accordance with the present invention.
FIG. 9 is an enlarged partial side-elevation view, partially in section, of the pole of FIG. 8.

Referring now to FIGS. 8 and 9, the present invention may be employed in the fabrication of break-away poles or in the conversion of existing wooden poles to break-away type poles. The foregoing is accomplished by forming reinforced pole sections, in the manner described above, both above and below a cut line at which the pole is severed. The jacketed upper and lower sections, particularly the cured resin encapsulating material, will reinforce the wood so that it can support break-away brackets. These brackets, of which there may be three (3) or four (4) per pole, are indicated generally at 40 in FIGS. 8 and 9. In the disclosed embodiment the brackets are generally L-shaped with a pair of side flanges. The base of each L-shaped bracket is provided with a through hole located intermediate the ends thereof and a U-shaped notch is provided at the outwardly disposed end of the base. The leg of each L-shaped bracket is provided with a pair of through-holes.

In forming a break-away pole in accordance with the present invention, the vertically oriented spacer members are first attached to the two pole sections. Next, the jackets are fitted and cut to size in the manner described above. The jackets are then reinstalled. The L-shaped brackets are then properly located, the holes through the legs marked and holes are drilled through the pole. Bolts, for example the bolts indicated at 42, are then passed through the L-shaped brackets 40 and the pole and are tightened to hold the brackets to the exterior of the jacket. If not already done, the lower end of the jacket on the lower pole section is plugged, in the manner described above, and the filler is poured into the lower jacket. When the resin has cured, a plate 44 is placed over the upper end of the lower pole section and in abutting relationship with the base portions of the brackets 40. A second plate 46, which will typically have the same shape as plate 44, is placed on plate 44. The plates 44 and 46 will provided, in their periphery, with U-shaped notches which are complementary to the notches in brackets 40. Additionally, the plates will be provided with through-holes which are in registration with the holes in the base portions of the brackets 40.

With both plates installed, the upper pole section is moved into position and the plates and brackets are bolted together by means of bolts 48. The bolts 48 are comprised of mild steel so that they may fracture in response to the application of sufficient stress. The next step in the fabrication process comprises the pouring of the resinous filler material into the jacket on the upper pole section. The break-away pole is completed by the installation of torsion bolts 50 in the U-shaped notches about the periphery of the plates and brackets using a torque wrench or similar tool.

As should now be obvious to those skilled in the art, the present invention provides a reliable and economic manner of restoring strength to a deteriorated utility pole and/or for preventing deterioration of such poles. Among the unique aspects of the present invention are the use of an outer form or jacket which may be fabricated on site and which, preferrably by virtue of a tongue and groove interlocking arrangement, may be adapted to any size pole. Restated, the jacket fabrication technique of the present invention allows the size of the void, which will be filled with a resinous material, to be kept constant regardless of the size of the pole within a given class of poles. Thus, the user may mix generally the same quantity of comparatively expensive resin each time the invention is practiced, the mixing of the resin taking into account the amount of pole rot which has been removed. Similarly, the present invention employs a pouring technique for the filler material which utilizes a reusable funnel and brackets. The funnel is preferrably fabricated from a pre-cut polyethelyene member and one size of these pre-cut members will fit all applications. The filler material, particularly the use of a resin having 100% solids, insures that there will be no voids inside the jacket and the employment of spacer members, which are attached to the pole itself and overlap portions of the pole which have not suffered deterioration, insures that the resulting pole structure will be of adequate strength.

While preferred embodiments have been shown and described, various modifications and substitutions may be made thereto without departing from the spirit and scope of the invention. Accordingly, it must be understood that the present invention has been described by way of illustration and not limitation.

What is claimed is:

1. A method of enhancing the characteristics of a standing pole comprising the steps of:

supporting a plurality of elongated spacer members about a portion of the exterior surface of a pole, the spacer members being oriented substantially in parallelism with respect to one another;

wrapping a first pliable sheet around the supported spacer members, the sheet having a first substantially straight edge;

marking the first sheet along a line adjacent to the overlapping of the said first edge;

removing the first sheet and severing the said first sheet along the marked line to form a second edge disposed oppositely and parallel to said first edge;

rewrapping the severed sheet around the supported spacer members and forming a leak-proof joint in the vicinity of said first and second edges, the rewrapped sheet defining a cavity about the pole, the spacer members being disposed in said cavity;

forming a pouring funnel about the pole with a second sheet of material, the smaller end of said funnel being disposed between the pole and said first sheet;

pouring an encapsulating material comprising an epoxy resin into the cavity via the funnel whereby the encapsulating material contacts and encapsulates the pole along the length of the cavity; and removing the funnel subsequent to the pouring of said encapsulating material.

2. The method of claim 1 wherein the step of forming the pouring funnel comprises:

attaching a plurality of brackets to the pole, said brackets including angularly outwardly extending arms; and supporting said second sheet on said bracket angularly extending arms.

3. The method of claim 1 further comprising the step of:

preparing the said second sheet by cutting a sheet of pliable material in the shape of a flat partial annulus.

4. The method of claim 2 further comprising the step of:

preparing the said second sheet by cutting a sheet of pliable material in the shape of a flat partial annulus.

5. The method of claim 1 further comprising the step of:

preparing the encapsulating material by mixing a resin with a hardener to form a 100% solids epoxy.

6. The method of claim 5 wherein the step of preparing the encapsulating material further comprises:

adding a filler to the epoxy.

7. The method of claim 4 further comprising the step of:

preparing the encapsulating material by mixing a resin with a hardener to form a 100% solids epoxy.

8. The method of claim 7 wherein the step of preparing the encapsulating material further comprises:

adding a filler to the epoxy.

9. The method of claim 1 wherein the step of supporting the spacer members about the pole comprises:

positioning the spacer members substantially parallel to the axis of the pole and spaced outwardly from the exterior surface of the pole.

10. The method of claim 9 wherein the step of positioning the spacer members comprises:

forming the spacer members by providing elongated linear members with projections extending from a first side thereof, said projections being placed in contact with the exterior surface of the pole.

11. The method of claim 10 wherein the step of positioning the spacer members further comprises:

mechanically fastening each of the elongated linear membranes to the pole at a plurality of locations along its length.

12. The method of claim 1 wherein the first edge of said first sheet defines a groove and wherein the step of rewrapping includes:

engaging the second edge in the groove defined by said first edge to form said joint.

13. The method of claim 12 wherein the step of forming the funnel comprises:

attaching a plurality of brackets to the pole, the brackets including angularly outwardly extending arms; and supporting the second sheet on said bracket arms, the second sheet being comprised of flat stock having the shape of a partial annulus.

14. The method of claim 13 wherein the step of supporting the spacer members comprises:

selecting spacer member comprising, elongated elements having plural projecting portions on at least a first side thereof;

placing the projections on said elements in contact with the exterior surface of the pole with the elements substantially parallel with the axis of the pole; and mechanically fastening each of the elements to the pole at a plurality of points along its length.

15. The method of claim 1 wherein the pole is severed along a line defined by the upper edge of said first sheet thereby forming upper and lower pole sections with said first sheet circumscribing said lower section, and wherein said method further comprises:

forming a cavity about the upper pole section with a pliable sheet;

filling said upper pole section cavity with said encapsulating material;

affixing a plurality of generally L-shaped brackets to said upper and lower pole sections, said brackets being in registration and in contact with the cavity defining sheets, the brackets on the upper pole section being oriented oppositely with respect to the brackets on the lower pole section; and joining said brackets to one another by a fastening system which will release in response to an impact directed transversely to the pole axis.

16. The method of claim 7 wherein the pole is in two sections and said cavity defined by said first sheet extends above and below the junction of said pole sections.

17. The method of claim 16 further comprising the step of:

shaping the abutting faces of the pole sections to define a complementary interlocking relationship therebetween.

18. A method of fabricating a break-away pole comprising the steps of:

supporting a plurality of elongated spacer members about a portion of the exterior surfaces of each of upper and lower abutting pole sections, the spacer members being oriented substantially in parallelism with respect to one another;

wrapping first pliable sheets around the supported spacer members, the sheets each having substantially straight edge first edges;

marking each of the first sheets along a line adjacent to the overlapping of its first edge;

removing the first sheets and severing them along the marked lines to form first sheet second edges disposed oppositely and parallel to said first edges;

rewrapping the severed sheets around the supported spacer members, the rewrapped sheets defining cavities about the pole sections, said cavities extending along the pole sections from the abutting ends thereof, the spacer members being disposed in said cavities;

affixing a plurality of generally L-shaped brackets to said upper and lower pole sections, said brackets being in registration on the sections and abutting the cavity defining sheets, the brackets on the upper pole section being oriented oppositely with respect to the brackets on the lower pole section;

forming a first pouring funnel with another sheet of material, the smaller end of said first funnel being disposed between the lower pole section and its jacket;

pouring an encapsulating material comprising an epoxy resin into the cavity via the first funnel whereby the encapsulating material contacts and encapsulates the lower pole section along the length of the cavity;

removing the first funnel subsequent to the pouring of said encapsulating material;

joining said brackets to one another by a fastening system which will release in response to an impact directed transversely to the pole axis;

forming a second pouring funnel about the upper pole section from sheet material, the smaller end of said second funnel being disposed between the upper pole section and its jacket;

pouring the encapsulating material into the cavity about the upper pole section via said second funnel whereby the encapsulating material contacts and encapsulates the upper pole section along the length of the cavity; and removing the second funnel subsequent to the pouring of the encapsulating material.

* * * * *